United States Patent [19]

Lohbauer

[11] 4,142,445

[45] Mar. 6, 1979

[54] CROSSOVER PLURAL CIRCUIT FLUID SYSTEM

[75] Inventor: Kenneth R. Lohbauer, Joliet, Ill.

[73] Assignee: Caterpillar Tractor Co., Peoria, Ill.

[21] Appl. No.: 778,650

[22] Filed: Mar. 17, 1977

[51] Int. Cl.[2] ..... F01B 25/02

[52] U.S. Cl. ..... 91/6; 91/523

[58] Field of Search ..... 91/412, 413, 414, 6, 91/450; 60/484, 486, 421, 427; 214/138 R

[56] References Cited

U.S. PATENT DOCUMENTS

| | | | |
|---|---|---|---|
| 2,445,781 | 7/1948 | Hrdlicka, Jr. | 60/97 |
| 2,768,499 | 10/1956 | Pilch | 60/52 |
| 3,693,350 | 9/1972 | Petro | 91/414 |
| 3,720,059 | 3/1973 | Schurawski | 60/421 |
| 3,800,699 | 4/1974 | Distler | 91/411 |
| 3,922,855 | 12/1975 | Bridwell | 60/484 |

FOREIGN PATENT DOCUMENTS 2336157 7/1976 Fed. Rep. of Germany.

*Primary Examiner*—Martin P. Schwadron
*Assistant Examiner*—Abraham Hershkovitz
*Attorney, Agent, or Firm*—John W. Grant

[57] ABSTRACT

A fluid system has at least first and second circuits, each connected to a pressurized fluid source. Each circuit has at least one preselected work element connected to the fluid source through a respective preselected controlling valve. A blocker valve is connected to one of the circuits and has an actuating assembly and is of a construction sufficient for controllably passing fluid from a preselected location on one of the circuits to a preselected location on the other circuit.

6 Claims, 1 Drawing Figure

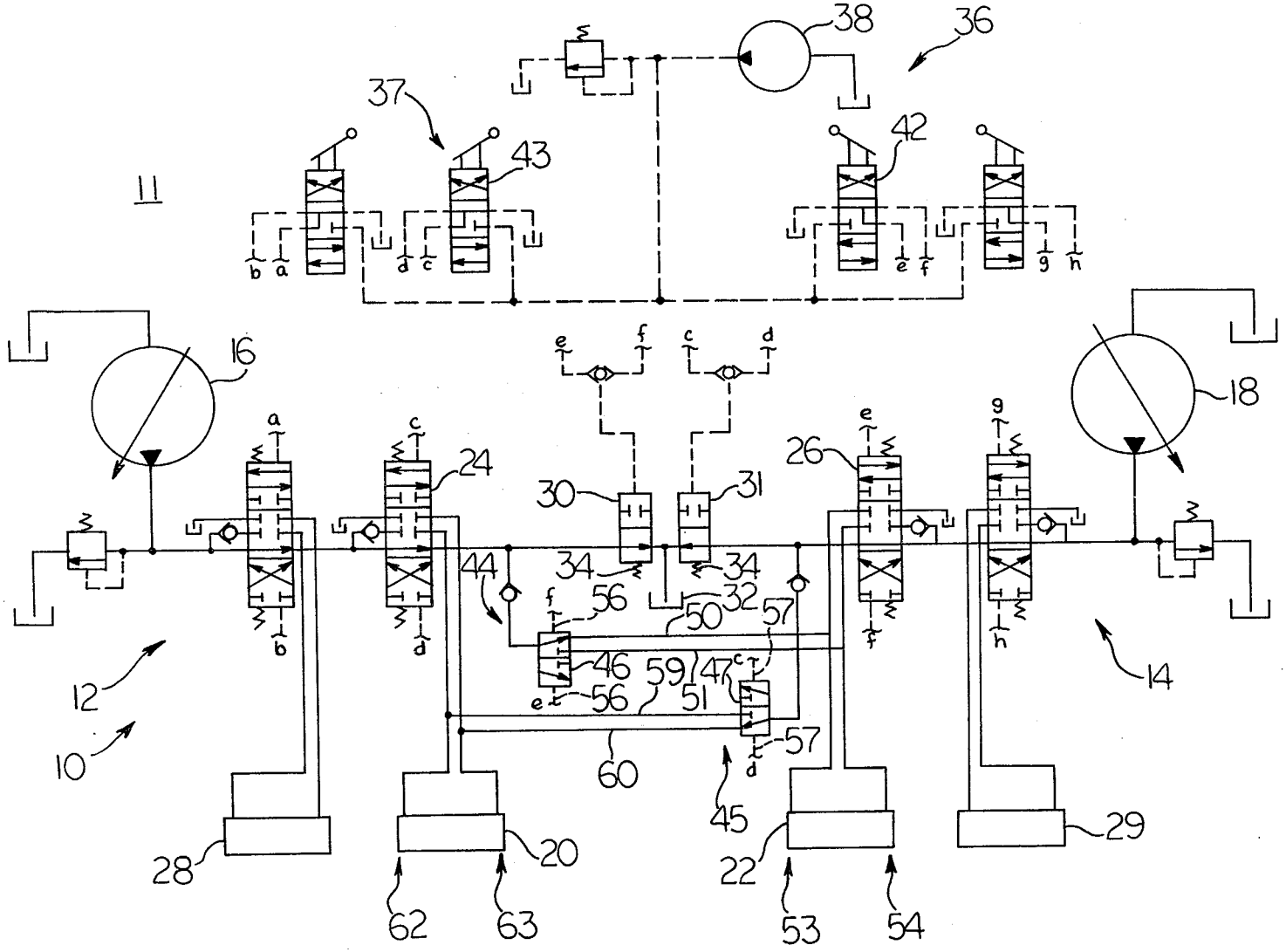
18
14
29
36
42
38
26
54
53
22
45
57
31
34
32
50
59
47
51
60
30
56
46
44
20
63
62
24
43
37
16
28
12
10
11

CROSSOVER PLURAL CIRCUIT FLUID SYSTEM

BACKGROUND OF THE INVENTION

In the construction of fluid systems serving a plurality of work elements through at least first and second circuits, it is desirable to be able to controllably, selectively combine the flows into the circuits. Fluid circuits have heretofore been supplied with control assemblies sufficient to permit fluid combining, however, there arose the problems of the control equipment having to be of undesirably large size in order to accommodate the increased fluid flow through the apparatus. This led to other problems such as compactness, excessive weight, undesirably low sensitivity, and others.

The present invention is directed to overcoming one or more of the problems as set forth above.

According to the present invention, a fluid system has at least first and second circuits each connected to a pressure fluid source. Each of the circuits has at least one preselected work element connected to the fluid source through a respective preselected controlling valve. A first blocker valve is connected on one side to a fluid reservoir and on the other side to the first circuit at a location downstream of the work elements of the first circuit. The first blocker valve is movable between a first position at which the first circuit is in fluid communication with the reservoir and a second position at which communication of the first circuit is blocked from said reservoir. A first control assembly is provided for moving the first blocker valve to the second position in response to actuating the second preselected controlling valve. A second control assembly is provided for passing fluid from the first circuit, at a location downstream of the first circuit work element, to a location in the second circuit downstream of the second preselected controlling valve of the second preselected work element of said second circuit.

BRIEF DESCRIPTION OF THE DRAWINGS

The drawing is a diagrammatic view of the fluid system of this invention on an excavator.

DETAILED DESCRIPTION OF THE INVENTION

Referring to the drawing, a fluid system 10 of an excavator 11, for example, has at least first and second circuits 12, 14. Each of the circuits is connected to a pressure fluid source, preferably respective first and second pumps 16, 18. Each circuit 12, 14 has at least one preselected work element 20, 22 each connected to their respective fluid source 16, 18 through a respective controlling valve 24, 26.

Other work elements 28, 29 can be positioned in the circuits 12, 14 at locations between the respective pumps 16, 18 and the respective preselected controlling valves 24, 26. The work elements 20, 22, 28, 29 can be, for example, the stick 20, the boom 22, the swing 28 and the bucket 29 of the excavator 11.

A first blocker valve 30 is connected on one side to the fluid recovery reservoir 32 and on the other side to the first circuit 12 at a location downstream of the work elements 20, 28 of the first circuit 12.

The first blocker valve 30 is movable between a first position (shown) at which the first circuit 12 is in fluid communication with the reservoir 32 and a second shifted position at which communication of the first circuit 12 is blocked from said reservoir 32. The first blocker valve 30 is normally maintained in the first position in response to a biasing means 34, for example a spring, which urges the blocker valve 30 toward said first position.

A second blocker valve 31 can be connected on one side to the fluid recovery reservoir 32 and on the other side to the second circuit 14 at a location downstream of the work elements 22, 29 of the second circuit 14.

The second blocker valve 31 is movable between a first position (shown) at which the second circuit 14 is in fluid communication with the reservoir 32 and a second shifted position at which communication of the second circuit 14 is blocked from said reservoir 32. The second blocker valve 31 is preferably of common construction relative to the first blocker valve 30 and is likewise biased toward the first position.

It should be understood that circuits 12, 14 and their associated elements can be reversed with the second circuit being called the first without departing from this invention and the numbering of the circuits was for convenience purposes. Also, the invention can be practiced without a second blocking valve 31 and its associated fluid control elements.

A first moving means 36 is associated with the first circuit 12 for controllably moving said first blocker valve 30 to the second position in response to actuating the second preselected controlling valve 26 of the second circuit 14.

A second moving means 37 is associated with the second circuit 14 for controllably moving said second blocker valve 31 to the second position in response to actuating the first preselected controlling valve 24 of the first circuit 12.

The first moving means 36 preferably includes a pilot pump 38 connected to the first blocker valve 30 via a first actuating valve with the first actuating valve 42 being connected between the pilot pump 38 and the first blocker valve 30. Controlling valve 26 is also connected to the pilot pump 38 through actuating valve 42.

The second moving means 37 can include a second blocker valve 31 connected to said pilot pump 38 and a second actuating valve 43 connected between the pilot pump 38, or a second pilot pump, if desirable, and the second blocker valve 31. Controlling valve 24 is also connected to the pilot pump 38 through actuating valve 43.

For clarity, the connecting fluid lines between the actuating valves 42, 43 and associated elements have been broken. In the drawing, line ends with like letters are in fluid communication in the fluid system 10.

A first fluid passing means 44 is provided in the first circuit 12 for passing fluid from the first circuit 12, at a location downstream of the work elements 20, 28, of the first circuit 12 to a location in the second circuit 14 downstream of the second preselected controlling valve 26 for delivering fluid to the second preselected work element 22 of said second circuit 14.

A second fluid passing means 45 can be provided in the second circuit 14 for passing fluid from the second circuit 14 at a location downstream of the work elements 22, 29, of the second circuit 14 to a location in the first circuit 12 downstream of the first preselected controlling valve 24 for delivering fluid to the first preselected work element 20 of said first circuit 12.

The first fluid passing means 44 has a first selecting valve 46 connected to the first circuit 12 at a location between the first blocker valve 30 and the work elements 20, 28. First and second conduits 50, 51 are each connected at one end to the first selecting valve 46 and at the other end to the second circuit 14 with each conduit 50, 51 being in fluid communication with a separate fluid end 53, 54 of said second preselected work element 22 of said second circuit 14.

A first shifting means 56 is provided for controllably shifting the first selecting valve 46 and passing fluid into a selected one of the first and second conduits 50, 51 in response to shifting the second preselected controlling valve 26 of the second circuit 14.

A second fluid passing means 45, preferably of similar construction relative to the first fluid passing means 44 can be provided for passing fluid from the second circuit 14 at a location downstream of the work elements 22, 29 of the second circuit 14 to a location in the first circuit 12 downstream of the first preselected control valve 24 to the first preselected work element 20 of said first circuit 12.

The second fluid passing means 45 has a second selecting valve 47 connected to the second circuit 14 at a location between the second blocker valve 31 and the work elements 22, 29. Third and fourth conduits 59, 60 are each connected at one end to the second selecting valve 47 and at the other end to the first circuit 12 with each conduit 59, 60 being in fluid communication with a separate fluid end 62, 63 of said first preselected work element 20 of said first circuit 12.

A second shifting means 57 is provided for controllably shifting the second selecting valve 47 and passing fluid into a selected one of the third and fourth conduits 59, 60 in response to shifting the first preselected controlling valve 24 of the first circuit 12.

In the operation of the apparatus of this invention, any fluid downstream of the work elements of the first or second circuits will be directed to the preselected work element 20 or 22 of the other circuit when said preselected work element 20 or 22 is in operation.

For example, actuation of actuating valve 42 causes a signal to be delivered into line "e" or "f" depending upon the type of action that is requested of work element 22. Signal "e" or "f" causes blocker valve 30 to close and selecting valve 46 to shift for combining fluid from the first circuit with fluid passing from pump 18 to work element 22.

It is particularly important to note that fluid crossing from one circuit to the other is injected into the other circuit at a location downstream of the respective controlling valve of said other circuit. Further, the shifting of the fluid streams is automatically accomplished in response to the position of the controlling valves. By so constructing the system, the problem as set forth above are overcome.

The embodiment of the invetnion in which an exclusive property or privilege is claimed are defined as follows:

1. In a fluid system having at least first and second circuits each connected to a pressure fluid source, each circuit having at least one preselected work element connected to the fluid source through a respective preselected controlling valve, the improvement comprising:

a fluid reservoir;

a first blocker valve connected on one side to the fluid reservoir and on the other side to the first circuit at a location downstream of the preselected controlling valve of the first circuit, said first blocker valve being movable between a first position at which the first circuit is in fluid communication with the reservoir and a second position at which communication of the first circuit is blocked from said reservoir, said first blocker valve being biased toward said first position;

first moving means for moving said first blocker valve to the second position in response to actuating the preselected controlling valve of the second circuit; and first fluid bypassing means for passing fluid from the first circuit, at a location between the preselected controlling valve of the first circuit and said first blocker valve, to a location in the second circuit between the preselected controlling valve of the second circuit and the preselected work element of said second circuit in response to said first blocker valve being moved to said second position.

2. A fluid system, as set forth in claim 1, wherein said first moving means comprises a pilot pump connected to the first blocker valve; and a first actuating valve connected between the pilot pump and the first blocker valve.

3. A fluid system, invention set forth in claim 1, wherein the first circuit has a work element positioned upstream of the preselected work element of said first circuit.

4. A fluid system, as set forth in claim 1, including a second blocker valve connected to the fluid reservoir and the second circuit at a location downstream of preselected controlling valve of the second circuit, said second blocker valve being movable between a first position at which the second circuit is in fluid communication with the reservoir and a second position at which fluid communication of the second circuit is blocked from said reservoir, said second blocker valve being biased toward said first position;

second moving means for moving said second blocker valve to the second position in response to actuating the preselected controlling valve of the first circuit; and second fluid bypassing means for passing fluid from the second circuit at a location between the preselected controlling valve of the second circuit and said second blocker valve to a location in the first circuit between the preselected controlling valve and the preselected work element of said first circuit.

5. In a fluid system having at least first and second circuits each connected to a pressure fluid source, each circuit having at least one preselected work element connected to the fluid source through a respective preselected controlling valve, the improvement comprising:

a fluid reservoir;

a first blocker valve connected on one side to the fluid reservoir and on the other side to the first circuit at a location downstream of the preselected controlling valve of the first circuit, said first blocker valve being movable between a first position at which the first circuit is in fluid communication with the reservoir and a second position at which communication of the first circuit is blocked from said reservoir, said first blocker valve being biased toward said first position;

first fluid passing means for passing fluid from the first circuit, at a location downstream of the preselected controlling valve of the first circuit, to a location in the second circuit between the preselected controlling valve and the preselected work element of said second circuit;

said first fluid passing means comprising:

a first selecting valve connected to the first circuit at a location between the preselected controlling valve of the first circuit and the first blocker valve;

first and second conduits each connected at one end to the first selecting valve and at the other end to the second circuit each in fluid communication with a separate fluid end of said preselected work element of said second circuit; and means for moving said first blocker valve to the second position and for controllably shifting the first selecting valve and passing fluid into a selected one of the first and second conduits in response to shifting the preselected controlling valve of the second circuit, said means including a pilot pump connected to the first blocker valve and a first actuating valve connected between the pilot pump and the first blocker valve.

6. A fluid system, as set forth in claim 5, including a second blocker valve connected to the fluid reservoir and the second circuit at a location downstream of the preselected controlling valve of the second circuit, said second blocker valve being movable between a first position at which the second circuit is in fluid communication with the reservoir and a second position at which fluid communication of the second circuit is blocked from said reservoir, said second blocker valve being biased toward said first position;

a second selecting valve connected to the second circuit at a location between the preselected controlling valve of the second circuit and the second blocker valve;

third and fourth conduits each connected at one end to the second selecting valve and at the other end to the first circuit each in fluid communication with a separate fluid end of said preselected work element of said first circuit; and means for moving the second blocker valve to the second position and for shifting the second selecting valve and passing fluid into a selected one of the third and fourth conduits in response to shifting the preselected controlling valve of the first circuit.

* * * * *